United States Patent [19]

Gross

[11] 4,003,648

[45] Jan. 18, 1977

[54] APPARATUS FOR MAKING ELECTRICAL CONTACT WITH AN ELECTROPHOTOGRAPHIC FILM

[75] Inventor: Frank C. Gross, Wilbraham, Mass.

[73] Assignee: A.B. Dick/Scott, South Hadley, Mass.

[22] Filed: Apr. 23, 1975

[21] Appl. No.: 570,821

[52] U.S. Cl. ..... 355/3 R; 355/54

[51] Int. Cl.[2] ..... G03G 15/00

[58] Field of Search ..... 355/3 R, 3 CH, 3 SH, 355/3 GE, 4, 11, 16, 44, 45, 53, 86, 54; 96/1 C; 250/324–326

[56] References Cited

UNITED STATES PATENTS

| | | | |
|---|---|---|---|
| 3,017,509 | 1/1962 | Crumrine et al. | 355/14 X |
| 3,697,176 | 10/1972 | Kuehnle et al. | 355/53 X |
| 3,723,111 | 3/1973 | Kojima et al. | 96/1 C |
| 3,840,300 | 10/1974 | Vane | 355/53 |

*Primary Examiner*—L. T. Hix
*Assistant Examiner*—Kenneth C. Hutchison
*Attorney, Agent, or Firm*—R. Duke Vickrey; John W. Kane, Jr.

[57] ABSTRACT

Disclosed is electrical connective means for establishing electrical contact with an electrically conductive area on the surface of an electrophotographic film held on a carrier within an imaging apparatus. The imaging apparatus includes an enclosure within which the film is imaged, a carrier for holding the film while it is imaged, reciprocating means for moving the carrier to and from a load position near an opening of the enclosure and an imaging position within the enclosure. The electrical connective means includes an electrical contact member connected to the carrier for making electrical contact with the conductive area on the surface of the film, engagement means for moving the contact member into electrical contact with the conductive area in response to movement of the carrier from the load position to the imaging position, and disengagement means for moving the contact member away from the recording member in response to movement of the carrier from the imaging position to the load position.

8 Claims, 7 Drawing Figures

APPARATUS FOR MAKING ELECTRICAL CONTACT WITH AN ELECTROPHOTOGRAPHIC FILM

BACKGROUND OF THE INVENTION

1. Field of the Invention

The present invention relates generally to systems for electrophotographically reproducing data on photosensitive film, and more particularly, to an apparatus for establishing electrical contact with the film while it is held on a carrier within an imaging apparatus.

2. Description of the Prior Art

Stimulated by the cost incurred in storing the everincreasing volume of documentary material which is presently being generated, considerable effort has been expended in the design and development of various electrophotographic and other data storage and retrieval systems. Particular emphasis has been placed on the design of microphotographic systems which may be used to decrease the physical bulk of such stored materials without sacrificing file retrieval and/or copy reproduction capabilities.

One type of apparatus for recording data on film for data storage is the indirect type of reproduction apparatus wherein a document is placed face down on a transparent platen and a light image is reflected from the document and directed by mirrors through a lens system and onto the film. This type of apparatus is disclosed in U.S. Pat. application Ser. No. 349,452, now Pat. No. 3,972,610, entitled Electrophotographic Method and Apparatus and filed Apr. 9, 1973 in the name of Frank C. Gross. In this type of system, the film, which is preferably a microfiche, must be securely held on the imaging axis at the proper focal length away from the lens system. Correct placement of the film is assured through use of a carrier having an alignment surface against which the film is firmly held when imaged. Since the carrier must be positioned inside of the enclosure of the photographic reproduction apparatus for imaging, it is not conveniently available for placement of a film, or microfiche, upon the carrier. This inconvenience is overcome by reciprocating the carrier to a load position near an opening of the enclosure and then back into the imaging position within the enclosure after placement of the film upon the carrier.

Conventional electrophotographic film in the form of microfiche is suitable for use in the apparatus described in U.S. Pat. application Ser. No. 349,452. Such film typically consists of a support layer having coated thereon a layer containing a suitable photoconductor. The support layer is made conductive by either the inclusion therein of electrically-conductive materials or by coating the support layer surface designed to receive the photoconductive layer with an electrically-conductive material. Images are formed on the photoconductive layer within the above-described reproduction apparatus by first applying a uniform electrostatic charge to the photoconductive layer and thereafter imaging the charged photoconductive layer by exposing it to light reflected from the document being reproduced, thereby causing the photoconductive layer to become conductive, which results in the dissipation of the charge in those areas of the photoconductive layer exposed to the light. In a subsequent step, the charge pattern or latent image on the photoconductive layer is rendered visible by the application thereto of colored or black electroscopic toner particles.

In operating the above-described reproduction apparatus, it is usually desirable during one or more of the processing steps, such as charging, imaging, or toning, to establish a ground connection (to a reference potential) or other electrical connection to the conductive layer of the film in order to create desirable electrical characteristics in the film. For this purpose, the film is usually provided with an electrically conductive area on the surface of the film. The electrically conductive area can be provided by filling a hole extending from the film surface to the conductive layer in a non-image area with an electrically-conductive composition, such as a mixture of plastic adhesive and electrically-conductive particles.

Some form of mechanical contacting means within the reproduction apparatus must be employed to make electrical contact with the conductive layer of the film and electrically interconnect it to the desired circuit, such as a ground. A number of techniques have been used, such as clips or clamps which are capable of engagement with the conductive area of the film, but they have generally lacked the ability of dependable electrical connection or have impeded placement and removal of the film on and from the carrier. Additionally, they usually have required manual operation to make the connection, which is inconvenient to the operator who needs free use of his hands to perform other chores attendant with recording information from documents.

In view of the disadvantages of the prior art, it is an object of the invention to provide electical connective means for establishing electrical contact with an electrically conductive area on the surface of an electrophotographic film. It is a further object of the invention to provide electrical connective means which will assure positive electrical contact with the electrically conductive area of the film without impeding placement or removal of the film on or from the carrier and without requiring manual operation.

SUMMARY OF THE INVENTION

These and other objects are accomplished by the present invention, which is an improvement in an apparatus for imaging an electrophotographic film. The apparatus includes an enclosure within which the film is imaged, a carrier for holding the film while it is imaged, and reciprocating means for moving the carrier to and from a load position near an opening of the enclosure and an imaging position within the enclosure. The improvement is electrical connective means for establishing electrical contact with an electrically conductive area on the surface of a film held on the carrier, and it comprises, in its broadest form, an electrical contact member connected to the carrier for making electrical contact with the conductive area, engagement means for moving the contact member into electrical contact with the conductive area in response to movement of the carrier from the load position to the imaging position, and disengagement means for moving the contact member away from the film in response to movement of the carrier from the imaging position to the load position.

In its preferred embodiment, the invention includes an electrical contact member mounted to the carrier with means which permits rotational movement of the contact member to and from a first position overlying the conductive area on the film and a second position not overlying the film, whereby the film can be placed on the carrier and removed from the carrier without impediment when the contact member is in the second position. The mounting means further permits reciprocating movement of the contact member towards and away from the film carrying surface of the carrier, whereby the rotational movement of the contact member can occur while the contact member is out of contact with the film. The preferred embodiment also includes cam means in a position fixed with respect to the carrier for causing the rotational movement and the reciprocating movement of the contact member when the carrier moves to and from the load position and the imaging position.

DESCRIPTION OF THE PREFERRED EMBODIMENT OF THE INVENTION

Figure 1:
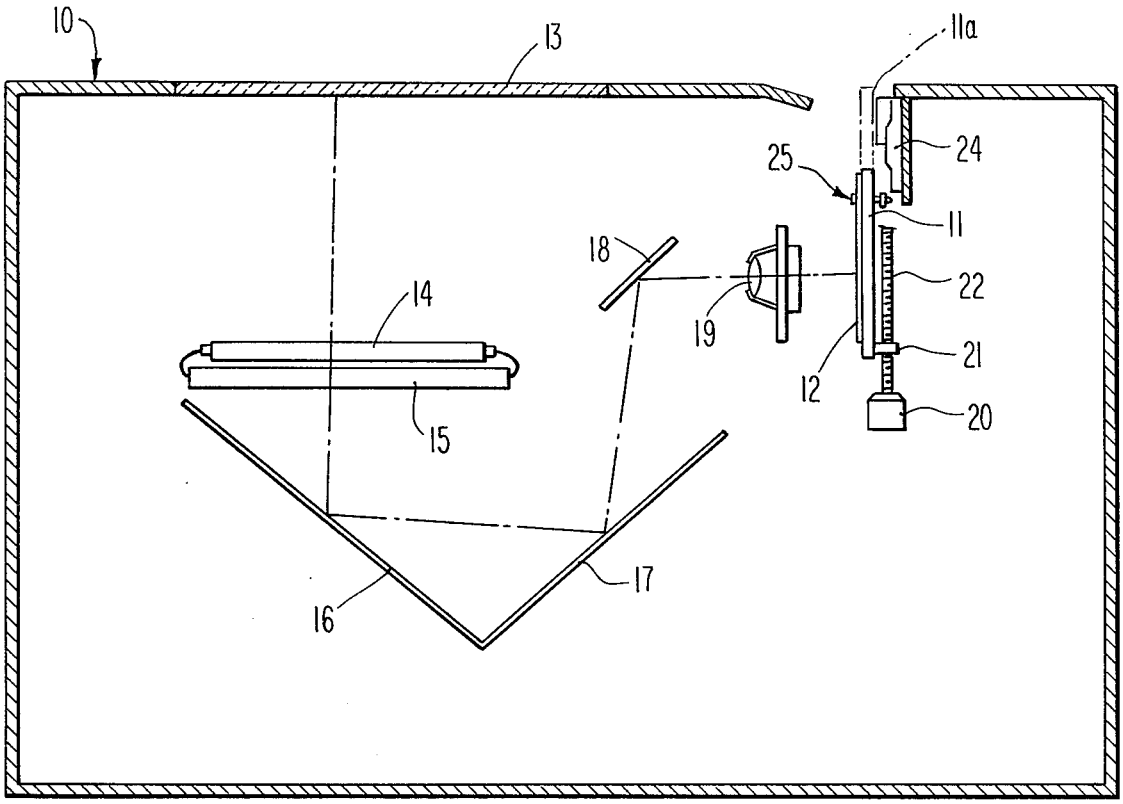
FIG. 1 is a schematic illustration of the electrophotographic imaging apparatus in which the electrical connective means of the invention is preferably employed.

The electrophotographic imaging apparatus in which the present invention is preferably employed, illustrated in FIG. 1, includes an enclosure 10 of generally rectangular configuration. The enclosure is designed to protect the operational parts of the apparatus and block out any undesired light. A carrier assembly having a microfiche carrier 11 is disposed within the enclosure 10 such that the carrier 11 may be transported upwardly to a position close to a slot in the enclosure 10 to a load position (illustrated in broken line and designated 11A) where a film in the form of a microfiche 12 may be conveniently placed upon the carrier 11. After placement of a microfiche 12 on the carrier 11, the carrier 11 is transported to the imaging position within the enclosure 10, as illustrated in FIG. 1.

On top of the enclosure 10 is a transparent copyboard 13 upon which a document may be placed for reproduction on the microfiche 12. Within the enclosure 10 is a lamp 14 and reflector 15 for reflecting light from the document and directing it by mirrors 16, 17, and 18 through lens 19 and onto the desired location on the microfiche 12 held by carrier 11 in the imaging position. The means for reciprocating carrier 11 to and from the load position and the imaging position is provided by conventional reversible electric motor 20 and screw 2 passing through threaded lug 21 on carrier 11.

Figure 2:
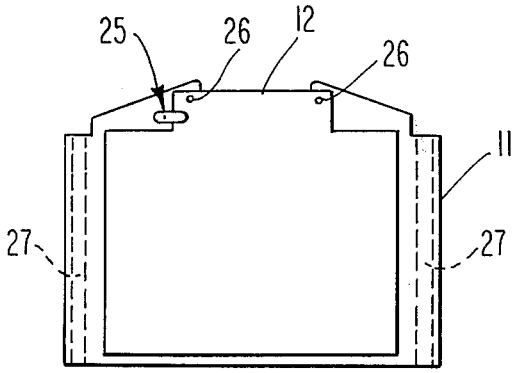
FIG. 2 is an illustration of the film carrier shown in the apparatus of FIG. 1, with the electrical contact member in contact with the electrically conductive area of a film.
Figure 3:
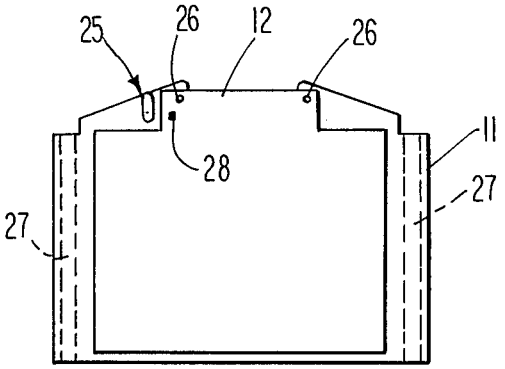
FIG. 3 is an illustration of the film carrier illustrated in FIG. 2, but with the electrical contact member positioned out of contact with the film to avoid interfering with placement or removal of the film on the carrier.

Carrier 11, referring to FIGS. 2 and 3, includes a flat, alignment surface facing the imaging means and against which the microfiche 12 is held during imaging. On both sides of the carrier 11 are cylindrical sleeves 27 through which guide rods (not shown) pass to guide the carrier to and from the load position and imaging position. The carrier 12 includes film-positioning pins 26 for insertion into corresponding positioning holes in the microfiche 12 to enable correct placement of the microfiche on the carrier 11.

The electrical connective means of the invention is provided generally by connective means 25 and cam means 24. The connective means 25 is mounted to the carrier 11 and moved to and from the enclosure 10 with the carrier 11. The cam means 24 is secured in a fixed position (with respect to the carrier) within the enclosure in a position to engage the connective means 25 as it moves to and from the load position and the imaging position with the carrier 11. The connective means 25 includes a generally flat elongate electrical contact member 34 (FIGS. 5, 6, and 7) which overlies a portion of microfiche 12 far enough to be in electrical contact with the electrical conductive area 28 on the surface of the film when the carrier is in the imaging position (FIG. 2) and does not overlie the film when the carrier 11 is in the load position (FIG. 3).

Figure 4:
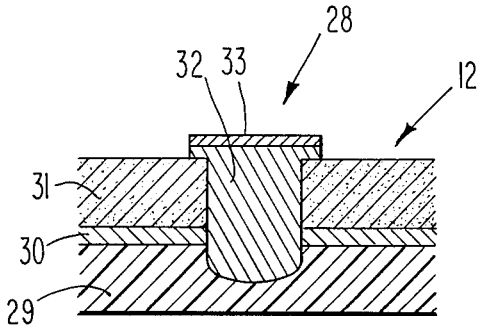
FIG. 4 is a cross-sectional segment of a typical electrophotographic film which can be employed in the apparatus of the invention.

An example of a preferred form of electrically conductive area 28 on the surface of the microfiche 12 is illustrated in FIG. 4. The microfiche 12 includes a support structure 29, a conductive intermediate layer 30, and an uppermost layer 31 of a photoconductive material. A slot or hole is provided through the photoconductive layer 31 and into the conductive layer 30. The slot or hole is filled with a conductive adhesive composition 26 and preferably covered with an adhesive-coated foil 33 to enhance electrical contact with the electrical contact member 34.

Figure 7:
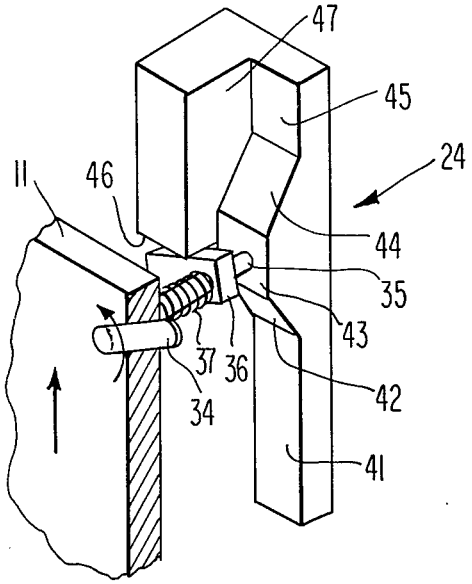
FIG. 7 is an isometric view of the electrical connective means of the invention, illustrating the electrical contact member beginning rotational movement from the first position overlying the conductive area of the film to the second position not overlying the film.
Figure 6:
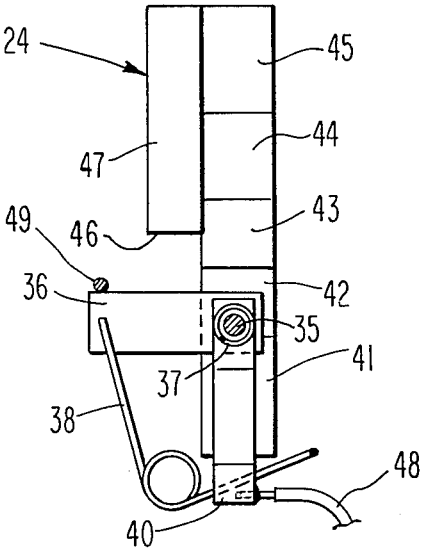
FIG. 6 is an elevation view taken along lines 6—6 of FIG. 5, illustrating the electrical connective means of the invention, but modified to show the carrier between the load position and the imaging position.
Figure 5:
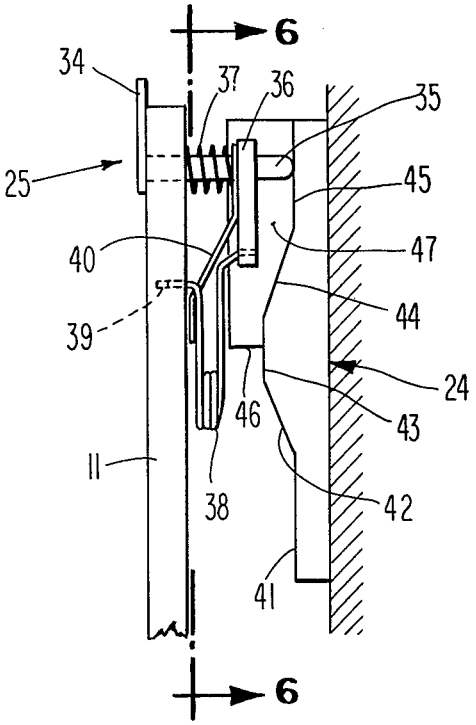
FIG. 5 is a cross-sectional elevation view of the electrical connective means illustrated in FIG. 1, but modified to show the carrier in the load position.

Referring to FIGS. 5, 6, and 7, the electrical contact member 34 is attached to the end of a cylindrical shaft 35 which passes through a hole or passageway in the carrier 11. Shaft 35 fits loosely within the hole in carrier 11 so that it can be freely rotated and moved back and forth within the hole. The end of shaft 35 opposite electrical contact member 34 is designed to engage a surface of cam means 24. A turning lever 36 is fixedly attached to shaft 35 near the end of shaft 35 which engages cam means 24. Turning lever 36 is designed to engage another cam surface of cam means 24 to cause rotation of shaft 35. A coil spring 37 is placed over shaft 35 between turning lever 36 and carrier 11 to bias the cam engagement end of shaft 35 towards cam means 24.

When carrier 11 is the imaging position (FIG. 1), shaft 35 is free of the cam means 25, which permits full retraction of shaft 35 towards cam means 24 and placement of conductive member 34 firmly against the conductive area 28 of a microfiche 12 on the carrier 11. When carrier 11 moves upwardly from the imaging position towards the load position, shaft 35 slides into engagement with lower vertical cam shaft 41 and then first sloping cam surface 42, which gradually pushes shaft 35 towards carrier 11 and moves electrical contact member 34 away from carrier 11 and out of contact with the condutive area 28 of a microfiche 12 held on carrier 11. As carrier 11 continues its upward movement towards the load position, shaft 35 slides into engagment with rotation-position cam surface 43, which is a vertical surface holding shaft 35 in its extended position and conductive member 34 out away from contact with the microfiche 12. With further upward movement of the carriage 11, shaft 35 slides into engagement with the second sloping cam surface 44, which permits electrical contact member 34 to return towards the film carrying surface of carrier 11 through the urging of coil spring 37. Finally, as carrier 11 approaches the load position, shaft 35 slides into engagement with the load-position cam surface 45, which permits complete retraction of conductive member 34 against the surface of carrier 11.

Turning-lever cam surfaces 46 and 47 are disposed to one side of the cam surface which engages shaft 35. The lower turning-lever cam surface 46 engages turning lever 36 while shaft 35 is engaging rotation-position cam surface 43 so that shaft 35 is rotated only when contact member 34 is away from microfiche 12. The portion of turning lever 36 which extends beyond shaft 35 is moved against lower cam surface 46, causing turning lever 36 to be rotated downward upon continued upward movement of a carrier 11. Turning lever 36 is disposed on shaft 35 in a direction 180° with respect to electrical contact member 34. After carrier 11 has moved upwardly sufficiently far enough to rotate turning lever 36 to a downward direction and it is no longer in contact with lower turning-lever cam surface 46, side turning-lever cam surface 47 prevents return of turning lever 36 to its horizontal position. A torsion spring 38 engages the end of turning lever 36 and an aperture 39 in carrier 11 to bias the turning lever 36 in a horizontal direction towards lower cam surface 46. When the carrier 11 is moving downwardly towards the imaging position, torsion spring 38 moves turning lever 36 back into its horizontal position after turning lever 36 has moved below lower turning-lever cam surface 46. Stop pin 49 mounted in carrier 11 (FIG. 6) prevents further rotation of turning-lever 36.

The first cam means (41, 42, 43, 44, and 45) for engaging shaft 35 and the second cam means (46 and 47) for engaging turning lever 36 cooperate together to cause the electrical contact member 34 to make the following movement. When the carrier 11 is in the imaging position, the electrical contact member 34 overlaps microfiche 12 and is in electrical contact with electrically conductive area 28 by being firmly pressed against microfiche 12 on carrier 11. Upon upward movement of carrier 11 towards the load position, the first cam means causes conductive member 34 to move out away from microfiche 12 and to be out of contact with the microfiche 12 and electrically conductive area 28. Further upward movement of the carrier 11 causes second cam means to rotate the electrical contact member 34 in an upward direction to be clear of the film carrying area of the carrier 11. And, as the carrier 11 moves into the load position, the first cam means causes the conductive member 34 to retract towards the carrier surface to be positioned flat against the carrier surface out of contact with microfiche 12. Thus, microfiche 12 can be conveniently removed from the carrier 11 and a new microfiche can be placed upon carrier 11 without interference from conductive member 34. After placement of a new microfiche on carrier 11, the carrier is returned to the imaging position, and the above-described steps are reversed, automatically bringing the electrical contact member 34 into electrical contact with the conductive area 28 on the microfiche 12.

A conductive link 40 is attached at one end to shaft 35 (see FIGS. 5 and 6). An electrically conductive wire 48 is connected to the other end of conductive link 40 (FIG. 6) and electrically connects electrical contact member 34 to the desired electrical circuit within the apparatus (for example, a grounding connection). Of course, this arrangement requires both the contact member 34 and shaft 35 to be made from electrically conductive material.

Having described the preferred embodiments of the invention, modifications within the scope of the invention will be obvious to those skilled in the art. For example, the priniciple feature of the invention is the ability to make dependable electrical contact with the conductive area of the microfiche 12 without the assistance of the operator and to move the conductive member 34 from a position on the carrier surface where it interferes with placement or removal of the film on or from the carrier 11. A further feature of the invention in its preferred form is reciprocation of the conductive member 34 away from the surface of the carrier 11 before conductive member 34 is turned towards or away from the microfiche 12 so that it can be rotated without interference from the microfiche 12. Cam means 24 described above is the preferred form of causing the described movements of the conductive member 34, but other means could be substituted.

While the invention has been described as used with an electrophotographic film, it is useful for making electrical contact with other forms of electrostatographic recording members. Accordingly, while the specification and claims refer to electrophotographic film, electrographic and other electrostatographic recording members are considered equivalents and within the scope of the claims.

What is claimed is:

1. In an apparatus for imaging an electrophotographic film comprising an enclosure within which the film is imaged, a carrier for holding the film while it is imaged, and reciprocating means for moving the carrier holding the film to and from a load position and an imaging position, the improvement of electrical connective means for establishing electrical contact with an electrically conductive area on the surface of the film comprising:

an electrical contact member connected to the carrier for making electrical contact with the conductive area;

engagement means for moving the contact member into electrical contact with the conductive area of a film placed on the carrier in response to movement of the carrier from the load position to the imaging position; and disengagement means for moving the contact member away from the film in response to movement of the carrier from the imaging position to the load position.

2. Apparatus according to claim 1, wherein the electrical contact member is connected to the carrier through mounting means for permitting rotational movement of the contact member to and from a first position overlying the conductive area and a second position not overlying the film, whereby the film can be placed on and removed from the carrier when the contact member is in the second position.

3. Apparatus according to claim 2, wherein the mounting means permits reciprocating movement of the contact member towards and away from the carrier, whereby the rotational movement of the contact member occurs while the contact member is out of contact with the film.

4. Apparatus according to claim 3, including cam means in a fixed position for causing the rotational movement and the reciprocating movement of the contact member.

5. Apparatus according to claim 4, wherein the cam means includes first cam surface means for causing the reciprocating movement of the contact member and second cam surface means for causing the rotational movement of the contact member.

6. Apparatus according to claim 5, wherein the contact member is attached to a shaft which extends through the carrier and engages the first cam surface means of the cam means, and a turning arm is attached to the shaft for engaging the second cam surface means of the cam means.

7. Apparatus according to claim 6, further including a coil spring biasing the shaft towards the first cam surface means of the cam means and a torsion spring biasing the turning arm towards the second cam surface means of the cam means.

8. An apparatus for imaging an electrophotographic film having an electrically conductive protuberance extending from an electrically conductive layer of the film through an overlying electrically insulating photoconductive layer, the apparatus comprising:

A. an enclosure within which the film is imaged;

B. imaging means within the enclosure;

C. a carrier for holding the film during imaging; the carrier including a passageway extending through the carrier at a position outside of the film holding area of the carrier;

D. reciprocating means for moving the carrier to and from a load position near an opening of the enclosure and an imaging position within the enclosure;

E. a shaft extending loosely through the passageway in the carrier;

F. an electrical contact member fixed at a first end of the shaft, the contact member extending perpendicular to the shaft far enough to reach the conductive protuberance of a film placed upon the carrier;

G. a turning arm fixed near the other, second end of the shaft and extending perpendicular to the shaft;

H. first biasing means for urging the shaft in a direction which will urge the contact member against the film surface;

I. second biasing means for urging the turning arm in a rotational direction which aligns the contact member with the conductive protuberance of a film placed upon the carrier;

J. first cam means mounted in a fixed position with respect to the carrier for engaging the second end of the shaft when the carrier moves from the load position to the imaging position and when the carrier moves from the imaging position to the load position and for moving the shaft against the first biasing means in a direction which will move the contact member away from the film surface;

K. second cam means mounted in a fixed position with respect to the carrier for engaging the turning arm when the carrier moves past the second cam means towards the load position and for rotating the turning arm against the second biasing means to turn the contact member into a position not overlying the film, the second cam means being positioned with respect to the first cam means to cause the contact member to be away from the film when it is rotated by the second cam means; and L. electrical contact means electrically connected to the contact member for electrically connecting the conductive protuberance to a circuit.

* * * * *